United States Patent [19]

Fitzgerald et al.

[11] 3,995,662

[45] Dec. 7, 1976

[54] FLUIDIC SWITCHES

[75] Inventors: Robert E. Fitzgerald, Wethersfield; Robert F. Kampe, West Hartford, both of Conn.

[73] Assignee: Chandler Evans Inc., West Hartford, Conn.

[22] Filed: June 16, 1972

[21] Appl. No.: 263,843

[52] U.S. Cl. ..... 137/825; 239/265.23; 60/231

[51] Int. Cl.[2] ..... F15C 1/04

[58] Field of Search ..... 137/842, 825; 239/265.23; 60/231

[56] References Cited

UNITED STATES PATENTS

| | | | |
|---|---|---|---|
| 2,956,400 | 10/1960 | Ferri | 239/265.39 |
| 3,212,259 | 10/1965 | Kepler | 60/231 |
| 3,354,645 | 11/1967 | Hsia | 60/231 |

*Primary Examiner*—Samuel Feinberg
*Attorney, Agent, or Firm*—Radford W. Luther

[57] ABSTRACT

Fluidic switches characterized by a first divergent region immediately downstream of a nozzle throat and a second downstream region of reduced divergence which will be contacted by a deflected jet. The switches of the present invention include control ports which are normally open to the ambient atmosphere, the ports being located at or near the free stream separation point, and the transition from the first divergent section to the second section is located at or near the attached stream separation point. The switches of the present invention may assume a circular cross-section and when so doing will be provided with a plurality of ribs on the internal surface for preventing circumferential flow about a deflected jet.

9 Claims, 3 Drawing Figures

FIG. 1
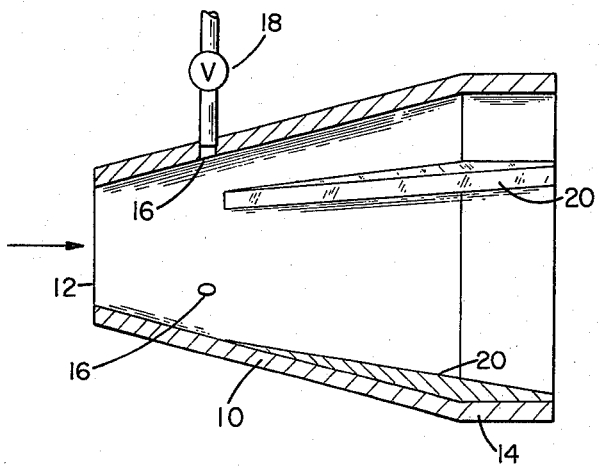
FIG. 2
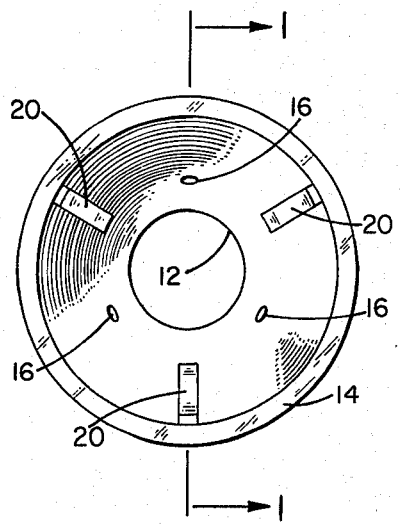
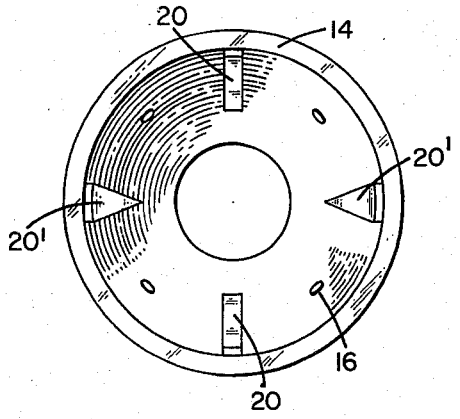
FIG. 3

FLUIDIC SWITCHES

BACKGROUND OF THE INVENTION

1. Field of the Invention

The present invention relates to the control of jets of fluid. More specifically, this invention is directed to multistable fluidic switches. Accordingly, the general objects of the present invention are to provide novel and improved methods and apparatus of such character.

2. Description of the Prior Art

While not limited thereto in its utility, the present invention has been found to be particularly well suited for use in thrust vector steering systems. As is well known, partial or total control over the direction of travel of a vehicle employing a gas generator as a propulsive source can be achieved by deflecting or vectoring all or a portion of the propulsive gases at an angle to their normal flow axis.

Prior art thrust vector control systems may be classified as either mechanical or hydromechanical devices. Regardless of type, all prior art thrust vector control schemes have been characterized by comparatively large size and weight, inefficient utilization of control and propulsive fluids and less than the requisite reliability.

In order to obviate the problems inherently associated with prior art thrust vector control systems, and to improve upon previous hydromechanical devices, it has been proposed to borrow from the fluidics art. That is, thrust vector controls employing fluid amplifier or switch type devices have been suggested. Such fluidic devices, which often rely for operation upon well known phenomena such as the Coanda effect, while theoretically offering substantial improvement over previous technology, have not found wide usage for a number of reasons. One of the more important deterrents to non-use has been the geometry of the prior art devices. It has previously been possible to maintain deflected flow in a desired radial nozzle sector with an acceptable degree of stability only by providing oppositely disposed flat surfaces to which the flow could attach. Such restriction to two dimensional shapes has severely limited flexibility. A further and associated problem with prior art fluidic control devices has been the excessive size of such apparatus. This excessive size has resulted from both the above-discussed two dimensional geometry and also from previous design philosophy which has dictated nozzle contour which diverged away from the normal stream axis in the downstream direction from the nozzle throat. An additional problem with prior art fluidic control devices has been embodied in excessive control gas flow.

Considering further, for purposes of explanation only, the use of a fluidic switch in a thrust vector control system, it has long been considered highly desirable to achieve both pitch and yaw and additionally roll control with the same apparatus. In the prior art, however, a rotational flow component has generally been achieved only by resort to a secondary flow injection which, of course, is wasteful of control fluid.

To summarize the deficiencies of prior art fluidic devices particularly as adapted for use as vehicle thrust vector controls, such devices were excessively large, made inefficient use of control fluid, were generally lacking in stability and slow to respond to switching command signals, could provide roll control in addition to pitch and yaw control only by resort to secondary gas injection and were characterized by short life due to poor resistance to erosion by the high temperature gases flowing therethrough.

SUMMARY OF THE INVENTION

The present invention overcomes the above-discussed and other disadvantages and deficiencies of the prior art by providing novel multistable fluidic switches particularly well suited for use in thrust vector control systems. When in the environment of a thrust vector control system the switches of the present invention are characterized by a circular nozzle cross-sectional shape with a plurality of stringers or low fences, hereinafter referred to as ribs, which extend axially on the inside surface of the nozzle.

Devices in accordance with the present invention are further characterized by a transition of the cross-sectional shape from divergent immediately downstream of the nozzle throat to a region of reduced divergence rate immediately upstream of the exit plane.

Also in accordance with the present invention, when supersonic flow is utilized the multistable fluidic switches are provided with control ports positioned at or near the free separation area of the undeflected stream in the interest of promoting early separation. In the circular thrust vector control embodiment this port location results in an inherently stable device which delivers axial thrust with all control ports open.

If roll control is desired the devices of the present invention may be provided with dissimilar shaped ribs in the interest of producing a rotational component of flow about the axis of a nozzle of circular cross-section.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIG. 1 is a cross-sectional side elevation view, taken along line 1—1 of FIG. 2, of a preferred embodiment of a multistable fluidic switch in accordance with the present invention;

FIG. 2 is an end view of the switch of FIG. 1; and

FIG. 3 is an end view of a second embodiment of the invention.

DESCRIPTION OF THE PREFERRED EMBODIMENTS

With reference now jointly to FIGS. 1 and 2, a preferred embodiment of a supersonic fluidic switch in accordance with the present invention, and employed in a thrust vector control, comprises a nozzle having a conical region or section 10 immediately downstream of the throat 12. At the downstream end of conical section 10 there is a transition in nozzle shape to a region 14 of reduced divergence rate. The transition from region 10 to region 14 may be either abrupt or gradual and in the preferred embodiment region 14 defines a cylindrical shape coaxial with the conical section and stream undeflected flow axis.

The embodiment of FIGS. 1 and 2 is provided with three control ports 16. Under normal conditions, that is when only axial output flow or axial thrust is desired, all of control ports 16 will be opened to the ambient atmosphere. When it is desired to deflect the stream; for example in the interest of generating a lateral or steering thrust component; the requisite one of control ports 16 will be closed. Closing of the control ports is achieved through the use of solenoid operated valves; one of such valves 18 being shown schematically in FIG. 1. The control ports 16 are located at or near the region of stream free separation as established with no flow attachment. This free side separation point may be determined employing experimental data obtained, for example, in the manner explained in an article entitled "Jet Separation In Conical Nozzles" by Sunley et al which appeared at pages 808–818 of the Journal of the Royal Aeronautical Society, Vol. 8, Dec. 1964. The Sunley et al article teaches the manner of predicting the pressure ratio at the free side separation point and, when this pressure ratio has been calculated, the area ratio or actual free separation point for the particularly nozzle geometry can be obtained by reference to the "Gas Tables" of Kennan and Kaye as published by John Wiley and Sons Company, Inc. in May, 1948. To briefly describe the function of the control ports, the stream exiting into the nozzle via throat 12 will normally pump gas by entrainment. The pumping action will continue after the closing of a selected port and a low pressure pocket or region will be formed in the vicinity of the closed port. As long as this low pressure pocket is maintained the stream will be deflected by the pressure differential thus generated thereacross.

Prior art attempts to provide a steerable gas stream in a fluidic switch or nozzle characterized by a circular cross-section have resulted in unstable devices. This instability has resulted from the flow of gas into the low pressure region from the downstream end of the nozzle; i.e., counter-flowing entrainment flow would pass upstream, in the area between the deflected stream and diverging nozzle wall, into the low pressure pocket and would thence be pumped or entrained by the stream. Additionally, circumferential flow about the stream into the low pressure pocket would also occur. In accordance with the present invention, there is a transition in wall shape from the comparatively rapidly diverging section 10 immediately downstream of throat 12 to a region 14 of reduced divergence rate adjacent the discharge end of the device. Thus, when compared to the prior art, the switches of the present invention limit in-flow by subtracting from the area available for such entrainment flow. Before stream deflection; i.e., in the "stable" mode; a greater portion of the entrainment flow is contributed by the control ports than is the case in a conventional divergent device. When one of the control valves 18 is closed and the stream switched from the normal axial flow path; i.e., an "unstable" deflected stream is produced; the stream will impinge on the inner wall of section 14 thereby sealing the boundary layer and preventing axial inflow. This action enhances the stability of the switching devices of the present invention. As will be obvious to those skilled in the art, the present invention is also characterized by rapid response to switching commands because of the enhanced effect of the control ports during the stable mode.

The actual optimum location of the break point of the devices of the present invention; i.e., the point of transition between the section 10 and the region 14 of reduced divergence rate, will be determined by tests. However, the break point will be in the region of the separation point of the attached stream. The separation point at the attached side is, of course, downstream of the separation point of the unattached or free side; i.e., the separation point moves downstream on the wall portion having a closed control port. Location of the attached side separation point may be predicted in the manner detailed in the paper entitled "Conical Rocket Nozzle Performance under Flow-Separated Conditions" by S. Kalt and D. Badal which appeared in the Journal of Spacecraft, Vol. 2, No. 3, May–June 1965 at pgs. 447–449. As in the case of locating the control ports, the Kalt et al paper will provide pressure ratio information and the area ratio may then be determined from the "Gas Tables."

As noted above, the instability resulting from disruption of the low pressure pocket formed when a control port is closed may be caused by circumferential flow as well as axial entrainment flow. Thus, in accordance with the present invention, a plurality of ribs or discontinuities 20 are provided on the inner wall of the switching devices. In the embodiment of FIGS. 1 and 2 the device is divided into three sectors, each with its own control port 16, by the provision of three of ribs 20. The ribs 20 start at or before the free side separation point and in the preferred embodiment extend to the discharge end of the device. The height and shape of ribs 20 will be determined by experimentation with the principal criteria being that the ribs must be of sufficient dimensions to restrict circumferential flow into the low pressure pocket. Thus, the ribs should protrude to a point where they will contact the deflected stream thereby sealing circumferential flow. As shown in FIGS. 1 and 2, the ribs 20 are of rectangular shape and increase in height in the downstream direction through the divergent portion 10 of the device. The ribs may, however, assume other shapes. Thus, the ribs may get wider toward the discharge end of the nozzle as shown in FIG. 3 and may actually be in the form of "flats" in the nozzle wall for all or a substantial portion of their length.

FIG. 3 depicts a second embodiment of the invention, also shown in the environment of a thrust vector control, which includes means for generating a rotational component of flow about the axis of the device. In the embodiment of FIG. 3 the nozzle is divided into four sectors via oppositely disposed pairs of ribs 20—20 and 20′—20′. Ribs 20′ are wedge shaped with their narrow ends facing in the upstream direction. Flow deflected into a sector bounded by one of wedge shaped ribs 20′ will be partially turned by the angular vane presented at one side of the rib while flowing parallelly along the straight vane presented by the rib 20 at the other side of that sector.

To fully understand the operation of the FIG. 3 embodiment it must first be recognized that, when the jet discharging into the nozzle from throat 12 attains supersonic velocity, the present invention will operate on an over expanded portion of the stream. Accordingly, by closing a pair of oppositely disposed control ports the jet will be caused to split and the divided stream will be deflected so as to come in contact with the opposite sides of oppositely disposed wedge shaped ribs 20′. This action will, of course, result in a roll moment being generated without the generation of any translational thrust. When translational thrust is desired a pair of adjacent control ports will be closed and, as will be obvious, in the translational mode there will be no rotational movement generated.

While embodiments of the present invention characterized by a circular cross-section have been shown and described, the present invention may also assume a two-dimensional shape with the control ports and transition points being similarly located. In the two-dimensional embodiment there will, of course, be no need for ribs 20. Accordingly, while preferred embodiments have been shown and described, various modifications and substitutions may be made thereto without departing from the spirit and scope of the present invention.

What is claimed is:

1. A fluidic switch comprising:

a first chamber defining member, said first member having an entrance end through which a stream of fluid may be injected and a discharge end, said first member being at least in part comprised of oppositely disposed wall portions which diverge at a first angle with respect to the axis of a stream of fluid supplied through said entrance end;

a second chamber defining member, said second member being positioned immediately downstream of said first member and having an entrance end for receiving the stream discharged from said first member and a discharge end, said second member being at least in part comprised of oppositely disposed wall portions which have a lesser rate of divergence than the first member wall portions, said first and second chamber defining members cooperating to define a reaction chamber;

means for exercising control over the position with respect to said axis of a stream of fluid in the reaction chamber, said position control means including at least a first control port in one of said first member diverging wall portions, said control port being located in the vicinity of the free stream separation point of an injected stream of fluid; and a plurality of rib means protruding into the reaction chamber, said rib means extending from the vicinity of the position control means to the vicinity of the second member discharge end and dividing the reaction chamber into a plurality of sectors, the height of said ribs being sufficient to insure contact with a deflected stream through the length of said first member.

2. The apparatus of claim 1 wherein said position control means comprises:

a control port for each of said sectors, said control ports normally being open to the ambient atmosphere; and valve means associated with each of said control ports for selectively interrupting communication between said ports and the ambient atmosphere when deflection of the stream is desired.

3. The apparatus of claim 2 wherein fluid entering the reaction chamber through said first member entrance end attains supersonic velocity and wherein the transition between said first member and second member is located in the vicinity of the separation point of the deflected stream from the reaction chamber wall on the attached side of the stream.

4. The apparatus of claim 3 wherein there are at least four of said rib means and wherein a pair of oppositely disposed rib means are wedge shaped with their narrow ends facing in the upstream direction.

5. The apparatus of claim 4 wherein said valve means are controlled so as to close said control ports in pairs, the closing of an oppositely disposed pair of ports generating a rotational component of flow about the axis of the apparatus and the closing of an adjacent pair of control ports generating a translational component of flow.

6. The apparatus of claim 3 wherein said first member comprises:

a conical section, the smaller diameter end of said conical section being open and defining the throat of a nozzle.

7. The apparatus of claim 6 wherein said second member comprises:

a cylindrical section, said cylindrical section being co-axial with said conical section.

8. A fluidic switch comprising:

a first member having a divergent wall in the form of a surface of revolution which defines a first chamber having an entrance end through which a stream of fluid may be injected thereinto and a discharge end through which the stream of fluid may exit therefrom;

a second member abutting the first member having a wall in the form of a surface of revolution which defines a second chamber in axial alignment with the first chamber and having an entrance end immediately downstream of the discharge end of the first chamber for receiving the stream of fluid exiting from the first chamber and a discharge end through which the stream of fluid may exit therefrom, the wall of the first member having greater divergence than the wall of the second member;

a plurality of circumferentially distributed control ports in the wall of the first member, the wall of the first member having such a length and divergence as to cause the stream of fluid to be overexpanded an extent sufficient to produce separation therefrom at a location upstream of the control ports when the control ports communicate with the ambient atmosphere;

valve means to interrupt communication between a selected control port and the ambient atmosphere for deflecting the stream of fluid with respect to the axis of the chambers toward the selected control port, the control ports being so axially positioned as to cause the deflected stream of fluid to separate from the wall portion surrounding the selected port at a location downstream from the selected port; and means to restrict circumferential flow to the deflected stream of fluid.

9. A fluidic switch, as defined in claim 8, wherein the first chamber is conical and the second chamber is cylindrical and wherein the downstream location of separation is adjacent the discharge end of the first chamber.

* * * * *